US008033926B2

(12) United States Patent
Brooks

(10) Patent No.: US 8,033,926 B2
(45) Date of Patent: Oct. 11, 2011

(54) GOLF SWING TRAINING DEVICE

(76) Inventor: Roger John Brooks, Lancaster (GB)

( * ) Notice: Subject to any disclaimer, the term of this patent is extended or adjusted under 35 U.S.C. 154(b) by 15 days.

(21) Appl. No.: 12/481,526

(22) Filed: Jun. 9, 2009

(65) Prior Publication Data

US 2009/0312113 A1 Dec. 17, 2009

(30) Foreign Application Priority Data

Jun. 12, 2008 (GB) ..... 0810765.8

(51) Int. Cl.
*A63B 69/36* (2006.01)

(52) U.S. Cl. ..... 473/226; 473/219; 473/231

(58) Field of Classification Search ..... 473/219, 473/226, 229, 231; D21/791
See application file for complete search history.

(56) References Cited

U.S. PATENT DOCUMENTS

| | | | | |
|---|---|---|---|---|
| 3,487,228 | A | 12/1969 | Kriegel | |
| D247,919 | S | 5/1978 | Goyette, Jr. | |
| 4,159,427 | A | 6/1979 | Wiedemann | |
| 4,206,608 | A | 6/1980 | Bell | |
| 4,321,475 | A | 3/1982 | Grub | |
| 4,495,424 | A | 1/1985 | Jost | |
| 4,514,977 | A | 5/1985 | Bowen | |
| 4,884,813 | A | 12/1989 | Cates | |
| 4,934,706 | A * | 6/1990 | Marshall | 473/241 |
| D324,897 | S * | 3/1992 | Colucci | D21/791 |
| D339,396 | S | 9/1993 | Roberto | |
| 5,277,428 | A * | 1/1994 | Goodwin et al. | 473/224 |
| 5,303,925 | A | 4/1994 | Rawson | |
| 5,441,270 | A | 8/1995 | Williams | |
| 5,905,312 | A | 5/1999 | Liou | |
| 6,100,600 | A | 8/2000 | Pflanz | |
| 6,359,347 | B1 | 3/2002 | Wolf | |
| 6,420,794 | B1 | 7/2002 | Cao | |
| 6,430,829 | B1 * | 8/2002 | Williamson et al. | 33/508 |
| 6,491,591 | B1 | 12/2002 | Schuster | |
| 6,605,005 | B1 | 8/2003 | Lin | |
| 6,766,643 | B2 | 7/2004 | Christensen | |
| D523,510 | S | 6/2006 | Hicks | |
| 7,244,187 | B2 | 7/2007 | Brooks | |
| D578,176 | S | 10/2008 | Brooks | |
| 2002/0072428 | A1 | 6/2002 | Lin | |
| 2002/0123385 | A1 | 9/2002 | Primiano | |

FOREIGN PATENT DOCUMENTS

| | | |
|---|---|---|
| WO | 2006/016855 | 2/2006 |

* cited by examiner

*Primary Examiner* — Nini Legesse
(74) *Attorney, Agent, or Firm* — Egbert Law Offices PLLC

(57) ABSTRACT

A device is provided for use in training a golfer to hit swing shots. The device includes an indicator securable to a shaft or handgrip of a golf club by an attachment device such that it points along a line at a predetermined acute angle relative to the longitudinal axis of the shaft. Preferably, the indicator is movable relative to the attachment device. In this case, a clamp is provided that allows movement of the indicator, such that it can be moved to point along a range of acute angles relative to the shaft and that can be tightened to clamp the indicator at a selected angle of the range. A plate with a scale marked thereon can also be provided and the indicator can include one or more needles that can be moved relative to the plate across the scale.

16 Claims, 9 Drawing Sheets

GOLF SWING TRAINING DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates a device for use in training a golfer to hit shots, in particular swing shots, consistently and accurately.

2. Description of Related Art Including Information Disclosed Under 37 CFR 1.97 and 37 CFR 1.98

The game of golf involves a variety of different strokes which are traditionally either swing shots or, when on the green, putts. Swing shots include long shots made with a full swing, for example when driving off or hitting a long shot to a green, shots made with a shorter swing (such as three-quarter swing or half swing), for example when hitting a fairly short shot to a green, and short shots such as chips, bunker shots and pitches that are usually made close to the green. When playing a long shot with a full swing, the club needs to be swung in such a way that it is moving at high speed when it strikes the ball. The path and orientation of the club head also need to be precise. A straight shot requires the path of the club head at impact to be along the intended direction of the shot and the angle of the club face to be at right angles to the intended direction of the shot. Small errors in either the path of the club head or the angle of the club face can cause the shot to miss the intended target by a considerable distance.

Developing an effective swing to hit accurate shots consistently is difficult as it requires the coordination of many body movements. The way the club is moved throughout the swing is very important. Incorrect movements at any point can lead to reduced power, mishits, inaccurate shots and inconsistency. As the golfer swings the club many errors can occur and it is difficult for a golfer to identify such errors.

Two of the most critical points in the swing are on the downswing and follow through when, from the viewpoint of an observer face on to the golfer, the club shaft is vertical. FIG. 1 is a representation of a golfer G with a club C held at this downswing point, and FIG. 2 is a representation of a golfer G with a club C held at the follow through swing point both figures being drawn from the viewpoint of an observer face on to the golfer. These points in the swing are just before and just after impact with the ball B respectively so that achieving the correct position for the club at these points is important in making an effective swing.

One component of the correct position is the angle of the club shaft from a viewpoint looking along the line of the shot. Ideally the club shaft should be swung between the downswing position of FIG. 1 and the through swing position of FIG. 2 along an imaginary plane. The ideal plane is such that the line of intersection where the plane meets the ground passes through the ball in the intended direction of the shot. Also, the angle of the plane to the ground should be the same as the lie angle of the club. FIG. 3 is a representation of a golfer G with a club C held in the downswing position from the viewpoint of an observer looking along the line of the shot, and FIG. 4 is a similar view but showing the follow through position of the club C. The dotted line in both FIG. 3 and FIG. 4 shows the position of the aforesaid plane and therefore the desired angle of the club shaft relative to the vertical when it is held in the correct position on the plane. The angle of the plane varies for different clubs because the lie angles of the clubs are different. The lengths of the clubs are also different, for example a driver is much longer than a wedge, and the golfer stands closer to the ball when using a club of shorter length.

A second component of the correct position at a point during the swing is the orientation or alignment of the club face. The alignment of the clubface can be defined by an imaginary line touching the clubface at the intended contact point with the ball, that is tangential to the face of the club and that is horizontal when the club is at the intended impact position. Irons typically have a planar face (whereas the face for woods is usually curved) with grooves that are horizontal when the club is at the intended impact position, in which case the alignment line is parallel to the grooves. In practice, the leading edge of an iron clubface and the top edge of a wood clubface, despite typically having slight curvature, are often used for an approximate visual assessment of the direction of clubface alignment. In the downswing position shown in FIGS. 1 and 3, ideally the club face alignment should be on or parallel to the plane defined by the shaft and the left forearm of the golfer and in the follow through position shown in FIGS. 2 and 4 the club face alignment should be on or parallel to the plane defined by the shaft and the right forearm of the golfer. Whether the alignment is on or parallel to the plane in the correct alignment depends on the design of the club and whether the alignment line crosses a straight line through the shaft or is offset from it.

In addition to the downswing and follow through points previously described, a third important point in the swing is in the backswing when the club shaft, from the viewpoint of an observer face on to the golfer, is vertical. The position of the club at this point should be similar to the downswing position already described and shown in FIGS. 1 and 3 (although the body position may be slightly different). As for the downswing position, the club shaft should be on the plane shown by the dotted line in FIG. 3 and the club face should be aligned so that it is on or parallel to the plane defined by the shaft and the left forearm of the golfer.

BRIEF SUMMARY OF THE INVENTION

The object of the present invention is to provide a device for use in training a golfer to hit swing shots consistently and accurately. In particular, it is an object of the invention to provide a device, which a golfer can use to determine whether his club is in the correct position at at least one of the three points described above on the backswing, the downswing and the follow through.

According to a first aspect of the present invention there is provided a device for use in training a golfer to hit swing shots comprising an indicator that is securable to a shaft or handgrip portion of a golf club by an attachment means such that it points along a line at a predetermined acute angle relative to the longitudinal axis of the shaft.

It will be appreciated that the handgrip of a golf club is secured over the upper part of the shaft of the club. As the device according to the invention is suitable for attachment either directly to the shaft or to a handgrip which covers part of the shaft, the term 'longitudinal axis of the shaft' when used herein and in the claims should be interpreted to include that part of the shaft located within the handgrip of the golf club.

Preferably, the indicator is movable relative to the attachment means and a clamping means is provided which allows movement of the indicator in order that it points along any of a range of acute angles relative to the longitudinal axis of the shaft and which is tightenable to clamp the indicator at a selected angle of the range.

Preferably also, the device comprises a plate with markings thereon and the indicator comprises a needle that can be moved over the plate relative to the markings.

Preferably also, the markings comprise at least one scale indicating ranges of acute angles on at least one side of the longitudinal axis of the shaft when the device is secured to the club.

Preferably also, at least two needles are provided that are clampable to the plate at a selected predetermined angle on either side of the longitudinal axis of the shaft respectively.

Preferably also, each of the needles is individually clampable at a predetermined selected angle.

Preferably also, the needle or needles are clamped to one side of the plate by a screw-fastener that engages a nut retained against rotation in a housing provided on the other side of the plate.

Preferably also, the plate carries at least one marking capable of alignment with the longitudinal axis of the shaft of the club when the device is secured to the club. This marking or markings should be aligned with the club face when the device is secured to the golf club.

Preferably also, the marking comprises edges or lines that are parallel to the longitudinal axis of the shaft when the device is secured to a club.

Preferably also, the attachment means comprises jaws which are hinged together to close around and clasp the shaft or handgrip portion of the golf club.

Preferably also, the jaws are held closed by a screw and captive nut arrangement.

Advantageously, the screw tightens against the force of a spring that acts to open the jaws as the screw is slackened.

Preferably also, the screw has a head with wings adapted for manual tightening and untightening of the screw.

Preferably also, the jaws each comprise ribs arranged so that the jaws define a smaller radius between the ribs and a larger radius outside the ribs in order that a range of diameters of shaft or handgrip portion can be gripped. Alternatively, the jaws are provided with a cushioning compliance in order that the device can be snug-fitted to the shaft or handgrip portion of the golf club.

According to a second aspect of the present invention there is provided an assembly comprising a golf club and a device for use in training a golfer to hit swing shots according to the first aspect of the invention.

BRIEF DESCRIPTION OF THE SEVERAL VIEWS OF THE DRAWINGS

An embodiment of the present invention will now be described by way of example with reference to the accompanying drawings.

DETAILED DESCRIPTION OF THE INVENTION

Figure 1:
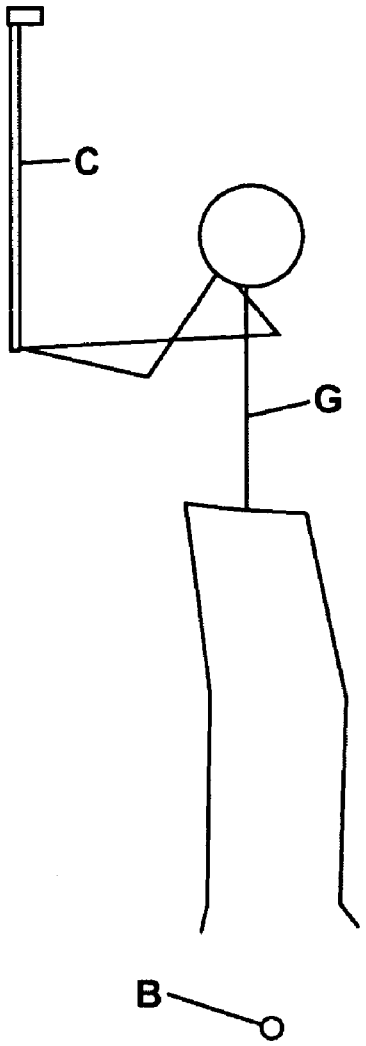
FIG. 1 is schematic view of a representation of a golfer with a club held at a position during a downswing when the club is vertical from the viewpoint of an observer face on to the golfer.
Figure 2:
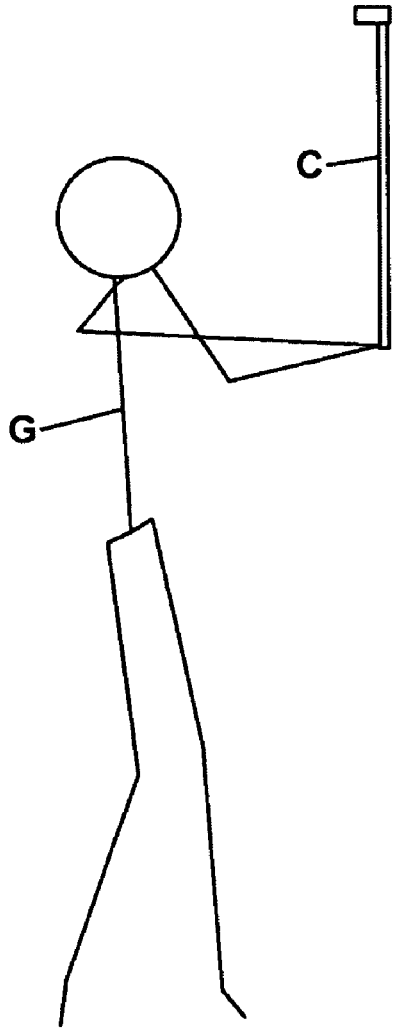
FIG. 2 is a schematic view of a representation of a golfer with a club held at a position during a through swing when the club is vertical from the viewpoint of an observer face on to the golfer.
Figure 3:
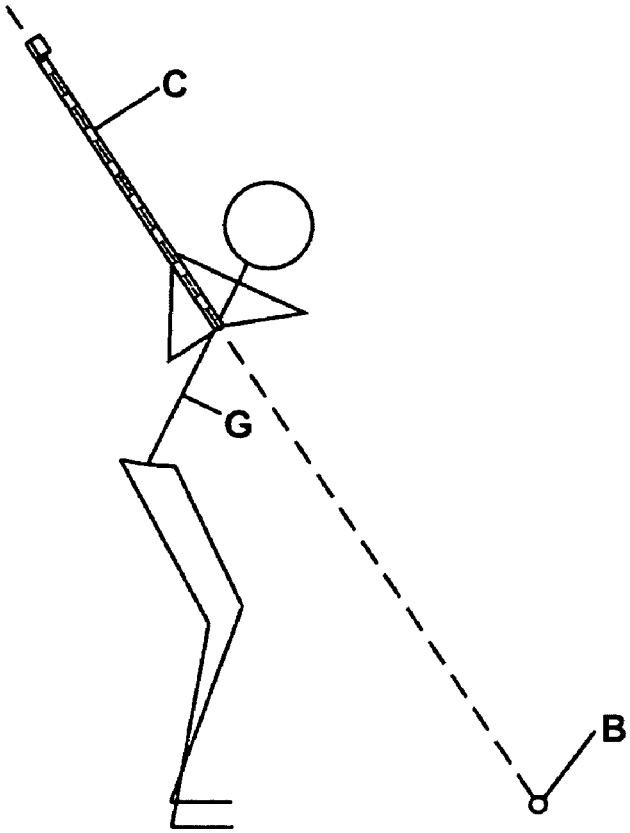
FIGS. 3 and 4 are schematic views similar to FIGS. 1 and 2 respectively but from the viewpoint of an observer looking along the line of the shot.
Figure 4:
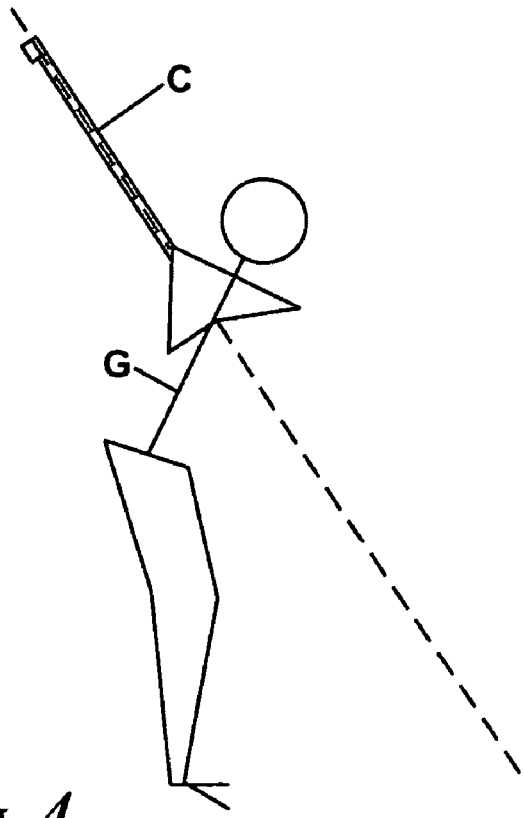
Figure 5:
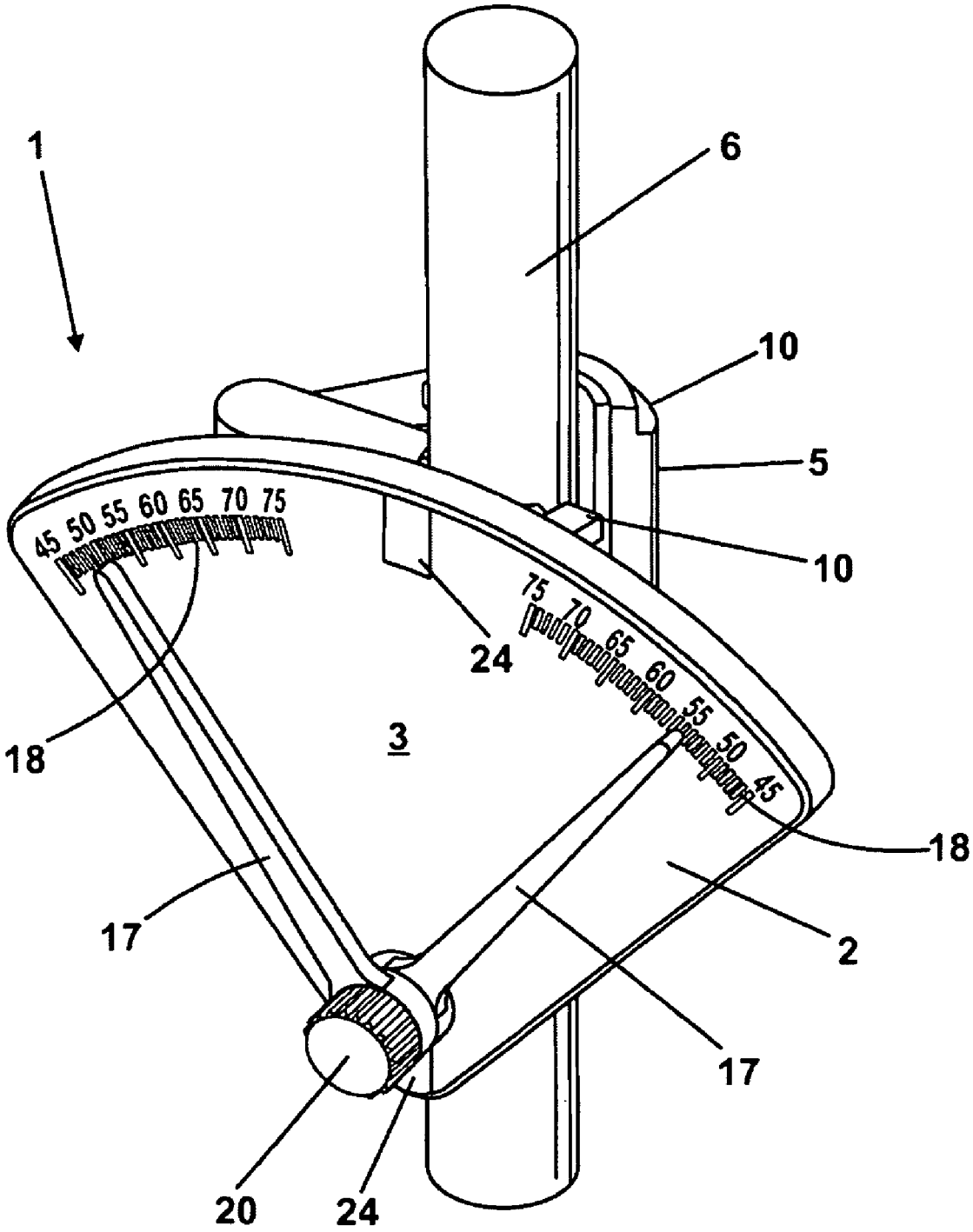
FIG. 5 is a perspective view of a first embodiment of device according to the present invention shown in a position wherein it is secured to a shaft of a golf club.
Figure 6:
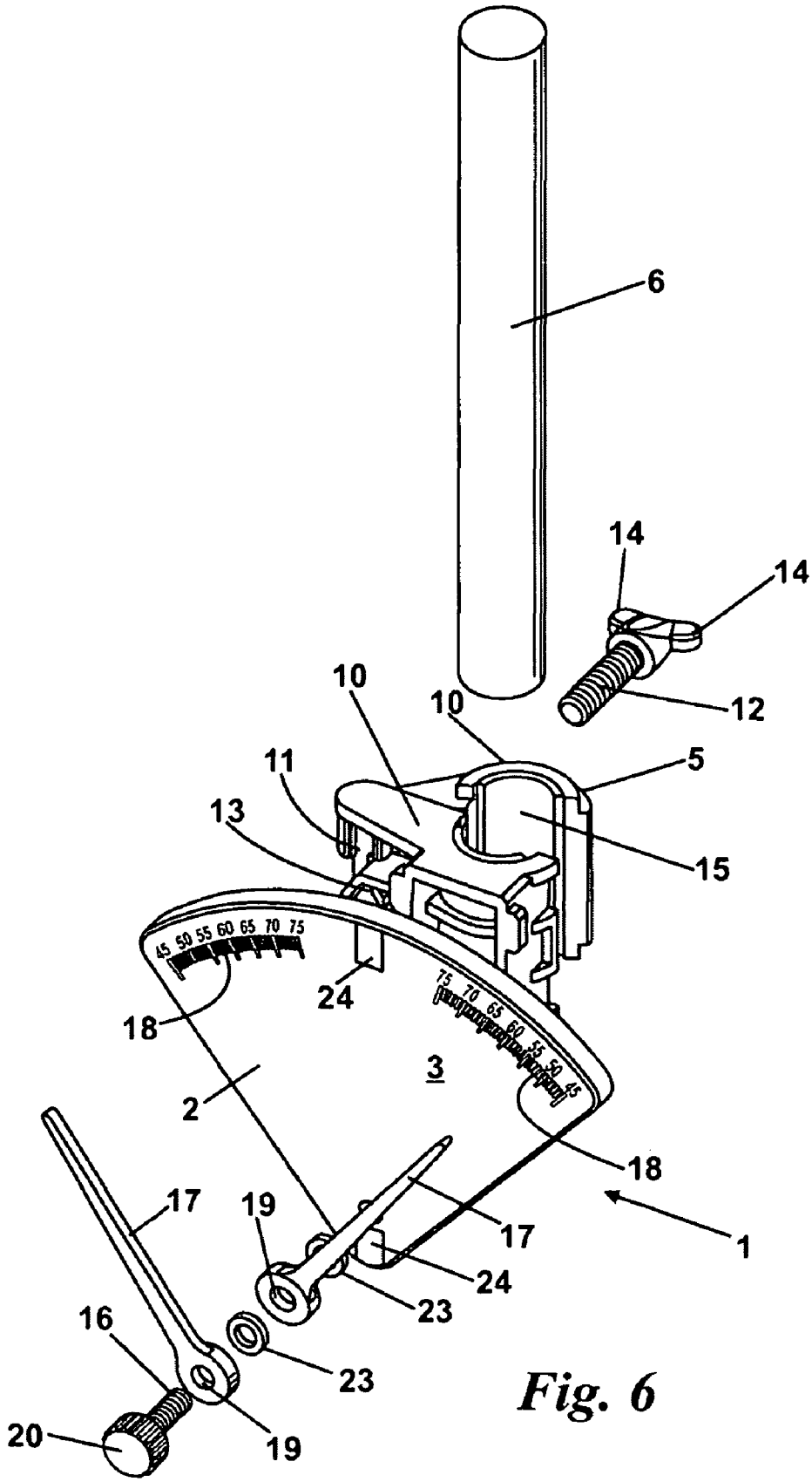
FIG. 6 is an exploded perspective view from the front and one side of the device shown in FIG. 5.
Figure 7:
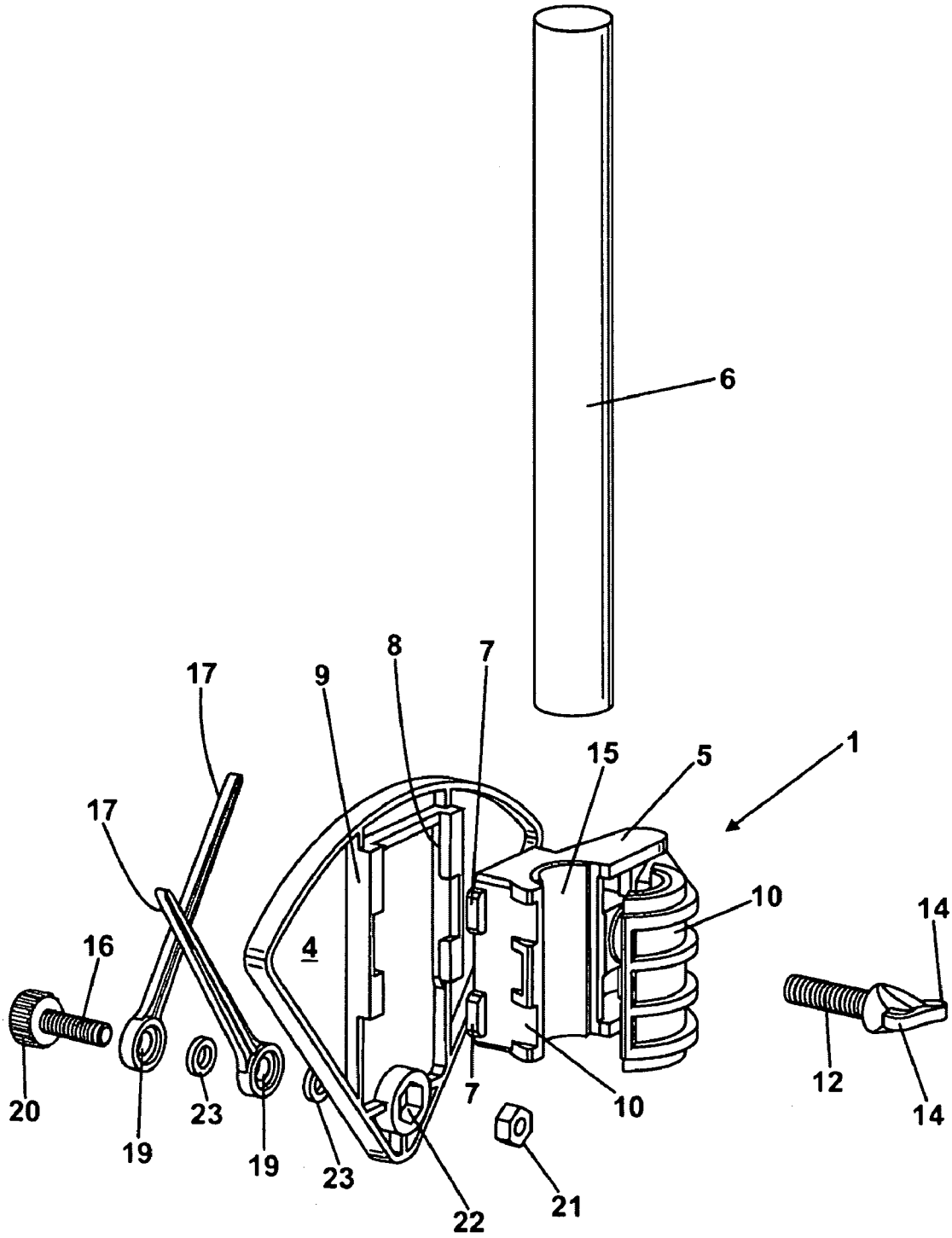
FIG. 7 is a perspective view similar to FIG. 6 but from the rear and one side.

FIGS. 5 to 11 show embodiments of devices 1 and 30 which are broadly similar in construction but with minor differences, as indicated in the following description. Both embodiments 1, 30 comprise a plate 2 with a front face 3 that is secured on its rear face 4 to an attachment means 5 for securing the device 1, 30 to a shaft 6 of a golf club either below or, preferably, over a handgrip 31 of the club. In either case, the attachment means 5 secures the plate 2 so that it lies in a plane parallel to the longitudinal axis of the shaft 6 of the club. It is therefore intended that the device 1, 30 will be supplied with the plate 2 pre-fitted to the attachment means 5 and it is not intended that the golfer uncouple these elements of the device from one another. In the device 1, the fitment is formed by projections 7 on the attachment means 5 that slide into channels 8 molded into a housing 9 on the rear face 4 of the plate 2. In the device 30, projections 32 are provided that snap-fit into channels 33 on the rear face 4 of the plate 2. However, it will be appreciated that the plate 2 and the attachment means 5 could be secured together in other ways, for example by screws, adhesive bonding or welding. Alternatively, they could be integrally formed.

The attachment means 5 comprises a pair of jaws 10 which are hinged together as at 11 to close around and clasp the shaft 6 or the handgrip 31. The jaws 10 are held closed by a screw 12 that engages in an aperture formed in the jaws 10 adjacent the hinge 11 and is screwed into a captive nut 13. In the second embodiment of device 30, the screw 12 tightens against the force of a spring 34 that acts to open the jaws 10 as the screw is slackened in order to facilitate location around the handgrip 31 in use. The screw 12 is intended to be manually tightened and untightened and its head has wings 14 to facilitate this manipulation. The jaws 10 are curved so that together they can clamp around the shaft 6 or handgrip 31. In order that the device 1 can fit a range of diameters of shaft 6, the jaws 10 may be provided with a cushioning compliance 15, for example of rubber or similar resilient material, which prevents damage to the shaft 6 and which provides a snug-fit to the shaft 6. Alternatively, in the device 30, which is shown attached to the handgrip 31, the jaws 10 are each provided with a pair of spaced ribs 35. The ribs 35 are arranged to run transversely across the jaws 10 so that they lie substantially parallel to the shaft 6 in use and the jaws 10 each define a smaller radius between its pair of the ribs 35 and a larger radius outside the ribs 35 so that a range of diameters of handgrip 31 can be gripped. The ribs 35 compress the handgrip 31 when the screw 12 is tightened and thereby ensure a tight fit.

Secured to the front face 3 of the plate 2 by means of a clamping means 16 is an indicator in the form of a needle 17 that can be moved over the plate 2 and used to point along a line parallel to the longitudinal axis of the shaft 6 or along a line at a selected acute angle relative to the shaft 6 when the device 1, 30 is secured to the shaft 6. To assist in the selection of a particular angle, at least one scale 18 is marked on the front face 3 of the plate 2 over which the needle 17 can be moved and which indicates a range of acute angles on at least one and preferably both sides of the shaft. In the illustrated embodiments, the scale 18 will show the angle of the shaft 6 to the horizontal when attached to a club held in the positions described below with references to FIGS. 8 and 9. The scale 18 therefore shows a range of acute angles, between 45° and 75° in device 1 and between 40° and 75° in device 30, on both sides of the longitudinal axis of the shaft on the front face 3 of the plate 2. The plate 2 is, therefore, of a sufficient size to accommodate such a scale 18, preferably by being made in the shape of a circular segment. In both embodiments two needles 17 are provided so that angles on both sides of the longitudinal axis of the shaft 6 can be indicated. It will be appreciated that the scale 18 could show other ranges of angles or the plate 2 could be provided with other appropriate markings. More needles, possibly made in different colours to facilitate differentiation, could also be provided.

The clamping means 16 enables the needles 17 to be individually clamped at their selected angle and comprises a screw-fastener which passes through eyes 19 formed in the ends of the needles 17 and which has an enlarged, knurled head 20 that clamps the needles 17 in the desired position when the screw-fastener is tightened in a nut 21. The nut 21 is retained against rotation in a housing 22 on the rear face 4 of the plate 2. Washers 23 are positioned between the needles 17 and between the needles 17 and the plate 2 to provide grip.

Figure 9:
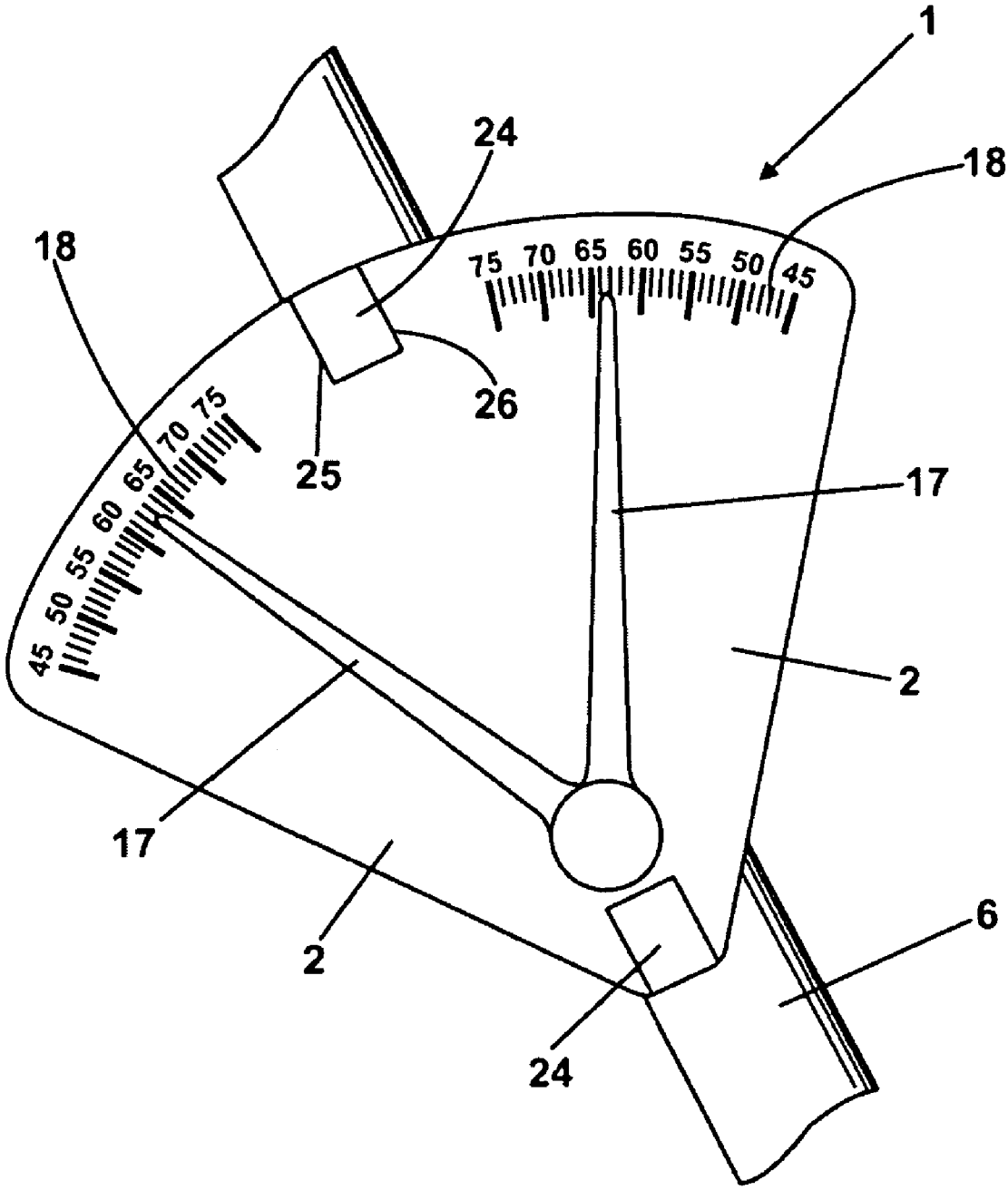
FIG. 9 is a perspective view similar to FIG. 8 but showing the view that a right-handed golfer sees when the club is in the correct position on the through swing position of FIGS. 2 and 4.
Figure 10:
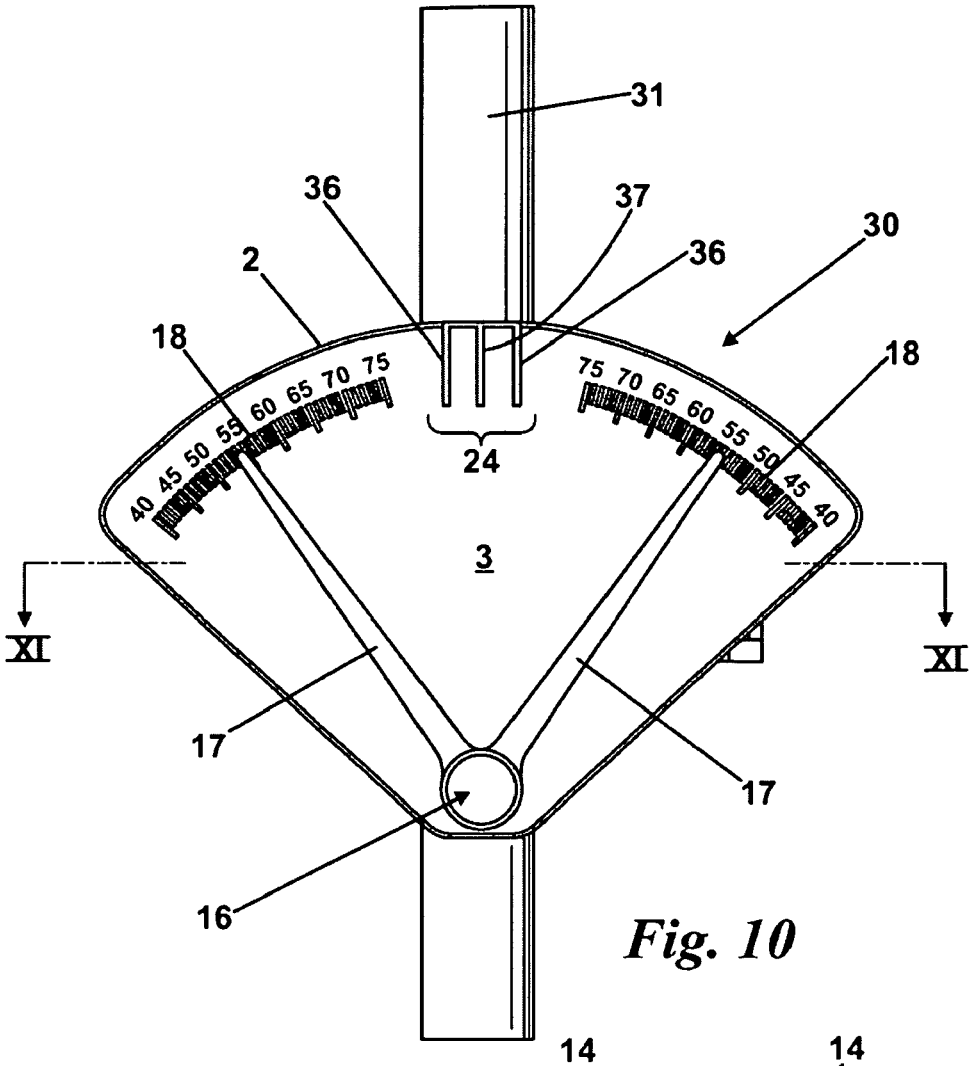
FIG. 10 is a front elevation view of a second embodiment of device when fitted around a grip of a golf club.
Figure 11:
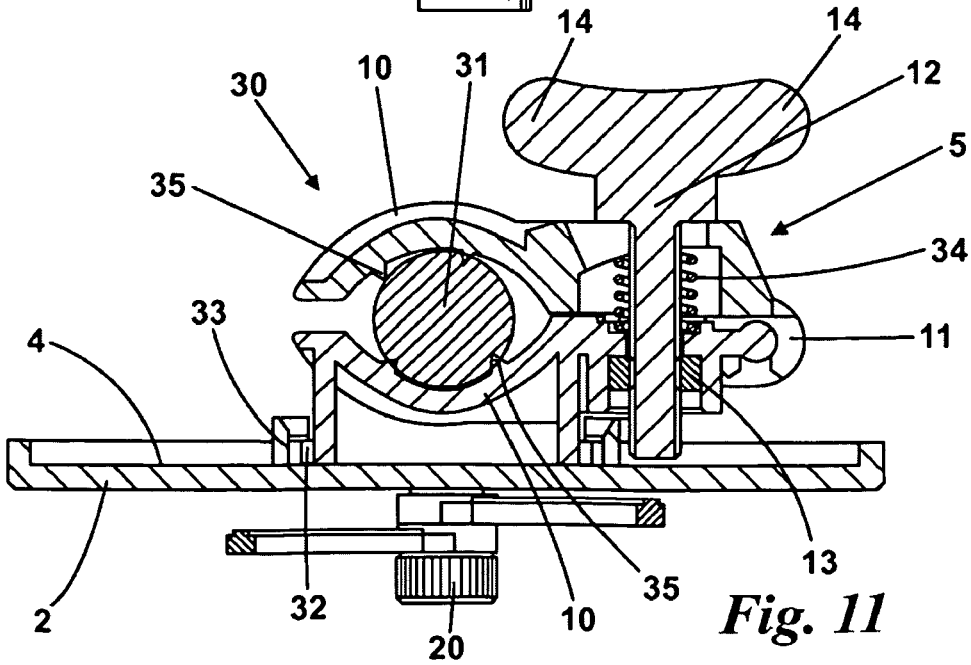
FIG. 11 is a transverse cross-section along the line XI-XI of FIG. 10.

The front face 3 of the plate 2 is also provided with at least one, and possibly two, additional markings 24 that are capable of alignment with the longitudinal axis of the shaft 6 of the club when the device 1, 30 is secured to the club. It is intended that these markings 24 will be used to show whether the club face alignment is correct. In the device 1, two markings 24 are provided in the form of rectangles, one of which is located centrally of the scale 18 and the other of which is located in alignment with it at the apex of the plate 2. The width of the rectangular markings 24, namely the distance between opposite sides 25 and 26 (see FIGS. 8 and 9), depends on the distance of the plate 2 from the surface of the shaft 6 or handgrip 31 when secured thereto and therefore varies dependent of the type of attachment means 5. The width of the rectangular markings 24 must therefore be determined individually for each design or size of device 1. Alternatively, as shown in FIG. 10, device 30 has only one marking 24 that takes the form of three parallel lines. The outer two lines 36 act in the same way as the sides 25 and 26 of the rectangular marking so that the middle of these lines align with the middle of the grip 31 in the backswing and downswing positions (see FIGS. 8 and 9). The middle line 37 is used to line up the device 30 correctly when it is secured to a club.

In use, the device 1, 30 is intended to provide feedback on whether the club is in the correct position at one or more points during a swing and can therefore assist the golfer to improve his swing and to play better golf. The device 1, 30 can also assist a coach when teaching a golfer. To this end, when using the device 1, 30 the golfer first moves the indicator needles 17 to the desired predetermined angles and clamps them in position using the clamping means 16 which stops the needles 17 moving when the club is swung. Preferably, both needles 17 are set to the same angle but on either side of the centre of the scale. This angle is preferably the lie angle of the club being used. Typical angles for different clubs could be specified in the instructions for the device 1, 30. Alternatively, the golfer could choose the angle or angles required according to the specification of the lie angles of his clubs or to suit his own preference, for example after advice from a coach. Some golfers or coaches may have alternative theories on the ideal plane angle and may even prefer different angles at the three different points in the swing mentioned above. The two needles could therefore be set to two of these angles and in a modified arrangement a third needle could also be provided to enable different angles to be indicated for all three points.

Figure 12:
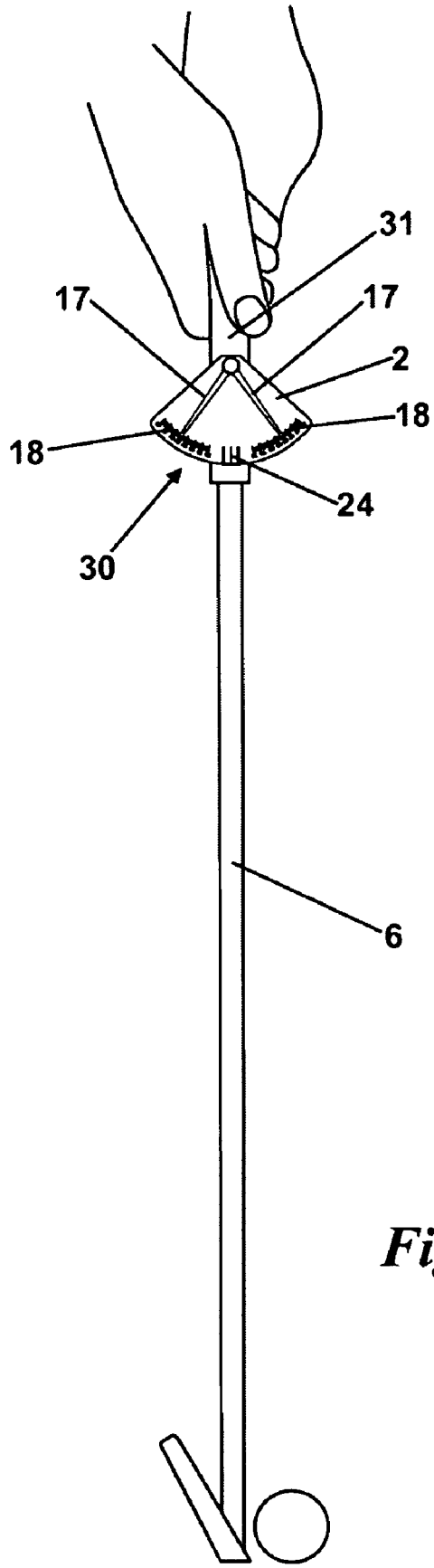
FIG. 12 is a schematic front view of the device shown in FIGS. 10 and 11 as it can be set up when the golf club is held in a position addressing a ball immediately prior to the taking of a swing shot.

The golfer then attaches the device 1, 30 to the golf club using the attachment means 5. The jaws 10 need to be closed sufficiently tightly to prevent the device 1 from moving when the golfer swings the club. The device 1, 30 should be attached to the club either just below the handgrip or, preferably, to the handgrip 31, as shown in the address position in FIG. 12, and should be aligned so that at the address position the plate 2 lies generally in a plane parallel to the intended line of shot and, from the golfer's viewpoint vertically above the shaft 6, the centre of the shaft 6 along its longitudinal axis is aligned with the centers of the rectangular markings 24 or with the line 37.

Figure 8:
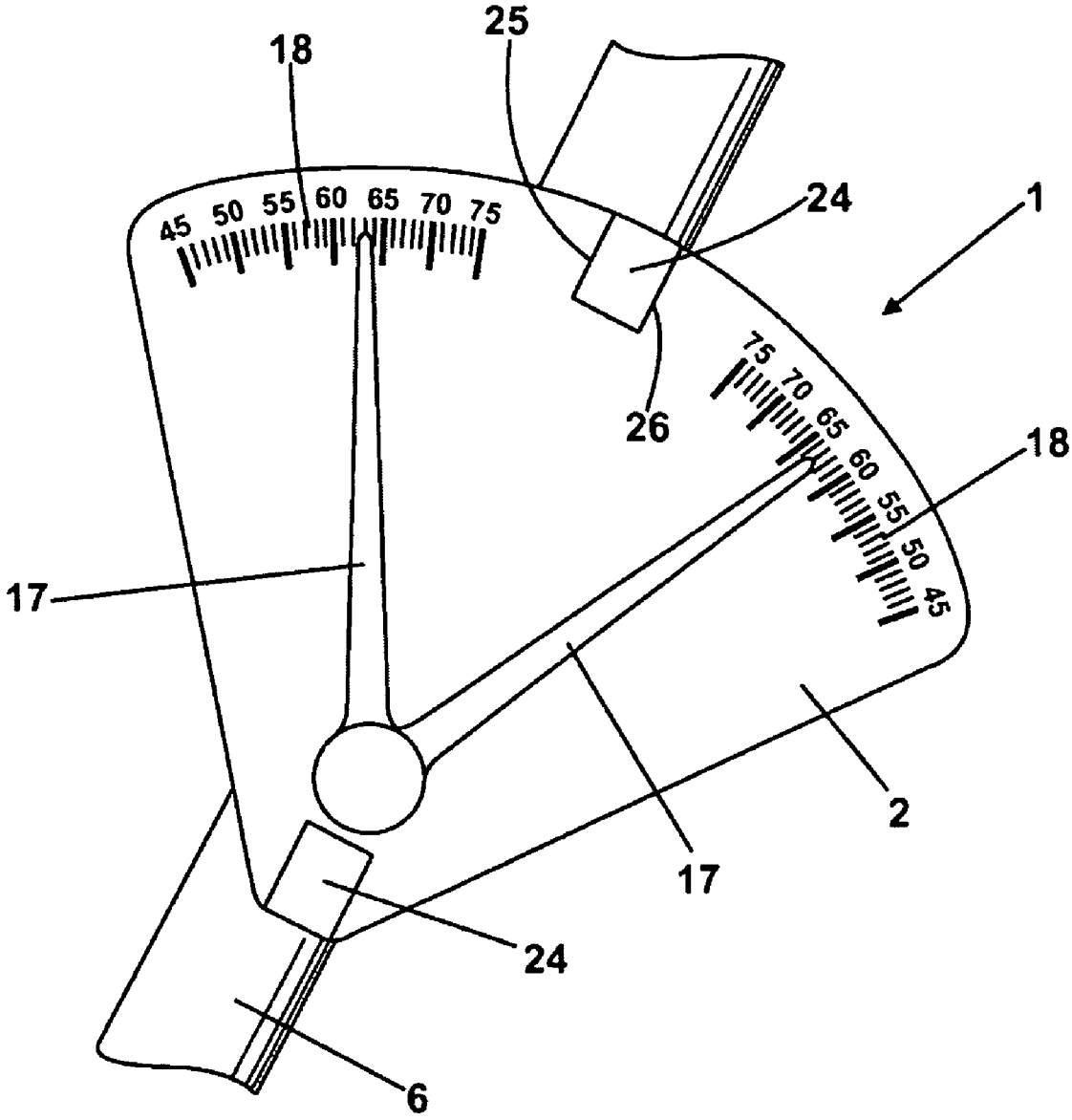
FIG. 8 is a perspective view to an enlarged scale of the front of the device shown in FIGS. 5 to 7 that a right-handed golfer sees when the device is attached to a club that is in the correct position on the backswing or downswing point shown in FIGS. 1 and 3.

When the golfer swings the club, he can check the position of the club at the backswing, downswing and follow through points shown in FIGS. 1 to 4. The golfer can do this by stopping the club at these points and using the device 1, 30 to check whether the club is in the correct position. FIG. 8 shows a right-handed golfer's view of the device 1 when the club is in the correct position on the backswing or downswing point of FIGS. 1 and 3. The left-hand needle 17 of the device 1, as shown in the drawing, is used to show whether the plane angle of the club is correct. The angle is correct when this needle 17 is vertical. The markings 24 are used to show whether the club face alignment is correct. The club face is correctly aligned when the top left edges 25 of the rectangular markings 24 appear in the middle of the shaft 6. FIG. 9 shows a right-handed golfer's view of the device 1 when the club is in the correct position on the through swing position of FIGS. 2 and 4. In this position, the right-hand needle 17 of the device, as shown in the drawing, is used to show whether the plane angle of the club is correct. The angle is correct when this needle 17 is vertical. The markings 24 are again used to show whether the club face alignment is correct. The club face is correctly aligned this time when the top right edges 26 of the rectangular markings 24 appear in the middle of the shaft 6.

As indicated, the above description applies for right-handed golfers but the device 1, 30 can be used in the same way for left-handed golfers. In this case, the view of a left-handed golfer on the backswing or downswing would be that shown in FIG. 9 and the view on the through swing would be that shown in FIG. 8.

The device 1, 30 can be attached to any club used to make full swings and there are various ways in which it can be used. In one example, the golfer swings the club slowly without using a ball and stops the swing at the backswing, downswing and through swing points previously described to check whether the club is in the correct position. By using the visual feedback from the device 1, 30 the golfer can learn to swing the club to achieve the correct positions. Repeated practice using the device 1, 30 can train the golfer to swing the club in a better way. This training should enable the golfer to swing in the same way when hitting the ball on the golf course.

A golfer could also hit shots with the device 1, 30 attached to the club. The golfer could make a practice backswing and stop the swing at the points shown in FIGS. 1 and 3. He can then use the device 1, 30 to check whether the club is in the correct position. The golfer can then take a real shot trying to repeat the same movements as on the practice swing. The golfer could also use a shortened swing that finishes at the point in the swing shown in FIGS. 2 and 4, and then use the device to check if the club is in the correct position at this point. The golfer could also start the swing from the position shown in FIGS. 1 and 3.

The device 1, 30 can also be used at other points during a swing. For example, when the club shaft is parallel to the ground and approximately at waist height in the backswing, downswing or through swing, the club face alignment should be in a vertical plane and the rectangular markings 24 should be in the middle of the shaft from the viewpoint of the golfer.

The device 1, 30 could also be attached to a shaft 6 in a different way if the golfer wishes to hit a fade or a draw rather than a straight shot. To learn a swing to hit a draw, the golfer should secure the device 1, 30 to the shaft 6 so that at address the centre of the rectangular markings 24 or the middle line 37 is to the right of the center of the shaft 6 from the golfer's point of view. To learn a swing to hit a fade, the golfer should secure the device 1, 30 to the shaft 6 so that at address the center of the rectangular markings 24 or the middle line 37 are to the left of the center of the shaft 6 from the golfer's point of view. The golfer then uses the device 1, 30 as previously described.

The device 1, 30 can also be used in the same way as described above for shorter pitch shots and bunker shots.

In another, simpler embodiment of a device according to the invention, an indicator or indicators 17 in the form of printed markings rather than adjustable needles could be used to show the plane angle. In this case, the plate 2 can be reduced to the form of one or more fingers, which could be fashioned with arrowheads rather than being printed with markings. Such indicators could not be moved relative to the attachment means 5 so that the device 1, 30 would be restricted in use to the plane angle or angles predetermined according to the position of the indicator or indicators.

In other embodiments, different markings 24 that indicate the alignment of the club face could be used rather than the rectangular markings described above. For example, arrows could be used instead of the rectangles and lines to show the correct position of the centre of the shaft 6 or of the edges of the shaft 6. Markings could also be used to show different alignments of the club face to that previously described. Coaches may have different theories on the correct alignment. Different alignments could also be used to hit a draw or a fade shot rather than a straight shot.

I claim:

1. A device for use in training a golfer to hit swing shots, the device comprising:

a golf club having a shaft and a handgrip portion;

at least two indicators;

an attachment means for attaching the indicators to said shaft or said handgrip portion so as to point the indicators along respective lines at respectively predetermined acute angles relative to a longitudinal axis of said shaft on either side respectively of said longitudinal axis of said shaft; and a plate with markings thereon, the indicators each having a needle movable over said plate relative to said markings.

2. The device of claim 1, wherein the indicators are movable relative to said attachment means, the device further comprising:

a clamping means for allowing movement of the indicators to point along any of a range of acute angles relative to said longitudinal axis of said shaft, said clamping means being tightenable for clamping the indicators at respective selected angles in the range.

3. The device of claim 1, further comprising:

a plate with markings thereon, the indicators each having a needle movable over said plate relative to said markings.

4. The device of claim 1, said markings comprising at least one scale indicating the ranges of acute angles on at least one side of said longitudinal axis of said shaft.

5. The device of claim 1, wherein each of the needles is individually clampable to said plate at a predetermined selected angle.

6. The device of claim 1, wherein the needles are clampable to said plate by a screw-fastener engaging a nut retained against rotation in a housing on another side of said plate.

7. The device of claim 1, wherein the plate carries at least one marking aligned with said longitudinal axis of said shaft.

8. The device of claim 7, wherein the marking has edges or lines parallel to said longitudinal axis of said shaft.

9. The device of claim 1, said attachment means comprising jaws hinged together so as to close around and clasp said shaft on said handgrip portion.

10. The device of claim 9, said jaws being held in a closed position by an arrangement of a screw and a captive nut.

11. The device of claim 10, wherein said screw tightens against a force of a spring.

12. The device of claim 10, said screw having a head with wings adapted so as to be manually tightened and loosened.

13. The device of claim 12, said jaws each comprising ribs arranged so that said jaws define a small radius between said ribs and a large radius outside of said ribs.

14. The device of claim 9, said jaws having a cushioning member thereon.

15. A device of use in training a golfer to hit swing shots, the device comprising:

a golf club having a shaft and a handgrip portion;

a plate with markings thereon;

at least two needles movable over said plate relative to said markings, the needles being clampable to a fixed position at a selected predetermined angle on either respective side of said longitudinal axis of said shaft; and an attachment means for securing the needles to said shaft or said handgrip portion such that the needles point along at respective predetermined acute angles relative to said longitudinal axis of said shaft.

16. A device for use in trainig a golfer to hit swing shots, the device comprising:

a golf club having a shaft and a handgrip portion;

an indicator; and an attachment means for securing said indicator to said shaft or said handgrip portion such that said indicator points along a line at a predetermined acute angle relative to a longitudinal axis of said shaft, said attachment means comprising jaws that are hinged together so as to close around and clasp to said shaft or said handgrip position, said jaws having ribs arranged so that said jaws define a small radius between said ribs and a large radius outside said ribs so as to accommodate a range of diameters of said shaft or said handgrip portion.

* * * * *